US006446840B2

(12) United States Patent
Ophardt et al.

(10) Patent No.: US 6,446,840 B2
(45) Date of Patent: Sep. 10, 2002

(54) APPARATUS FOR MAKING AND DISPENSING FOAM

(75) Inventors: Heiner Ophardt, Vineland (CA); Ali Mirbach, Issum (DE)

(73) Assignee: Ophardt Product KG, Issum (DE)

( * ) Notice: Subject to any disclaimer, the term of this patent is extended or adjusted under 35 U.S.C. 154(b) by 0 days.

(21) Appl. No.: 09/855,126

(22) Filed: May 14, 2001

(30) Foreign Application Priority Data

May 18, 2000 (DE) ..... 100 24 149
Feb. 21, 2001 (DE) ..... 101 08 299

(51) Int. Cl.[7] ..... B67D 5/58
(52) U.S. Cl. ..... 222/190
(58) Field of Search ..... 222/189, 190, 222/211, 212

(56) References Cited

U.S. PATENT DOCUMENTS

| | | | | |
|---|---|---|---|---|
| 4,343,417 A | | 8/1982 | Corsette | |
| 5,048,750 A | * | 9/1991 | Tobler | 222/189 |
| 5,110,052 A | | 5/1992 | Graf et al. | |
| 5,326,000 A | | 7/1994 | Fuchs | |
| 5,445,288 A | | 8/1995 | Banks | |
| 5,570,819 A | * | 11/1996 | Uehira et al. | 222/190 |
| 5,779,104 A | | 7/1998 | Reidel | |
| 5,906,299 A | | 5/1999 | Hagleither | |
| 6,053,364 A | | 4/2000 | Van Der Heijden | |

FOREIGN PATENT DOCUMENTS

| | | |
|---|---|---|
| EP | 0 392 238 | 3/1990 |
| EP | 0 613 728 | 3/1994 |
| EP | 0613728 | 7/1994 |
| EP | 0 930 102 | 8/1998 |
| EP | 0 985 455 | 3/1999 |
| EP | 0 953 381 | 4/1999 |
| EP | WO 01/39893 | 6/2001 |
| WO | WO 00/23199 | 10/1999 |
| WO | WO 00/30520 | 11/1999 |
| WO | WO 00/64593 | 4/2000 |

* cited by examiner

*Primary Examiner*—William C. Daerrler
*Assistant Examiner*—Thach H. Bui
(74) *Attorney, Agent, or Firm*—Herbert Dubno; Andrew Wilford

(57) ABSTRACT

An apparatus for making and dispensing foam has a housing forming a generally closed foaming chamber, a liquid pump for drawing liquid from a supply and spraying the liquid into the foaming chamber, and an air pump for forcing air into the foaming chamber. A conduit forms a continuously open passage having an inner end opening into the foaming chamber and an outer end open to outside. A foam generator in the foaming chamber mixes the spray and air therein to generate foam and expand the foam to flow through the conduit out the outer end thereof. The liquid pump includes a small-diameter liquid chamber and a small-diameter liquid piston displaceable therein and the air pump includes a large-diameter air chamber and a large-diameter air piston displaceable therein and coupled directly to the liquid piston.

17 Claims, 7 Drawing Sheets

APPARATUS FOR MAKING AND DISPENSING FOAM

FIELD OF THE INVENTION

The present invention relates to an apparatus for making and dispensing foam. More particularly this invention concerns such an apparatus used for making soap or detergent foam.

BACKGROUND OF THE INVENTION

A standard pump-type soap dispenser has several disadvantages. It normally only puts out a small amount of concentrated soap or detergent with each actuation so the user normally actuates it a few times, taking substantially more than is really needed. Furthermore the devices are only usable in combination with a water faucet, as the concentrated soap or detergent simply cannot be conveniently spread around sufficiently to do the desired cleaning job. In addition such devices are often quite messy, dripping their sticky contents from the end of the dispensing spout when not in use.

Recourse has therefore been had to foam-generating and dispensing systems such as described in U.S. Pat. No. 6,053,364 of E. van der Heijden. This system has separate air and liquid pumps associated with complex valves that ensure that a charge of compressed air is combined with the liquid to form foam. Furthermore the seal system for the air pump is such that it has a very limited service life and, as a result, this system is normally made disposable so that once the supply of liquid soap is exhausted, the entire device with the pump is discarded.

OBJECTS OF THE INVENTION

It is therefore an object of the present invention to provide an improved apparatus for generating and dispensing foam.

Another object is the provision of such an improved apparatus for generating and dispensing foam which overcomes the above-given disadvantages, that is which is of simple construction yet which is of such durability that it can be refilled or the pump assembly can be reused with a new liquid supply.

SUMMARY OF THE INVENTION

An apparatus for making and dispensing foam has according to the invention a housing forming a generally closed foaming chamber, a liquid pump for drawing liquid from a supply and spraying the liquid into the foaming chamber, and an air pump for forcing air into the foaming chamber. A conduit forms a continuously open passage having an inner end opening into the foaming chamber and an outer end open to outside. A foam generator in the foaming chamber mixes the spray and air therein to generate foam and expand the foam to flow through the conduit out the outer end thereof.

Since the system works basically at atmospheric pressure, the sealing problems of the pressurized prior-art system are largely avoided. No outlet valve is needed to release foam when a predetermined pressure is reached, nor is a valve system between the two pumps. Furthermore the low-pressure operation of the system of this invention means that the user only needs to exert modest force to actuate the pumps. At the same time it is relatively easy, even at such low pressure, to produce a good soap foam. In fact the foam can be so voluminous that no water needs to be added to it for washing purposes, water only being needed for rinsing off.

The liquid pump in accordance with the invention includes a small-diameter liquid chamber and a small-diameter liquid piston displaceable therein and the air pump includes a large-diameter air chamber and a large-diameter air piston displaceable therein and coupled directly to the liquid piston. The supply is a vessel holding the liquid and to which the housing is removably attached. Thus the pump assembly can be used over and over with different soap/detergent containers in accordance with the commercially available "ingo-man" system.

In accordance with the invention the air pump has an intake connected to the foaming chamber and draws air in through the conduit. The conduit, the air piston, and the air chamber are of such dimensions that displacement of the air piston between end positions moves a volume of air greater than a volume of air held in the conduit between its ends. Thus when the pumps return to their starting position, the air pump sucks back in any foam in the conduit so that nothing will drip from its end.

The air pump includes an unlubricated seal between the air piston and an inner surface of the air chamber. More particularly the seal is formed of a polyolefin, for example polyethylene (PE), low-density polyethylene (LDPE), polypropylene (PP), or an elastomer such as a thermoplastic elastomer (TPE), an acrylonitrile rubber (NBR), or ethylenepropylenediene rubber (EPDM).

The seal has a flexible lip engaging the surface at an acute angle. In the aspirating system the seal has a pair of oppositely directed flexible lips engaging the surface at acute angles for sealing in both directions. The air piston moves in a predetermined forward direction to move air from the air chamber into the foaming chamber and in the one-lip system the seal lip projects generally in the forward direction and engages the surface at an acute angle.

The foam generator according to the invention includes at least one sieve. In another system it has a pair of frustoconical foraminous sieves aligned with and flaring away from each other and can include a flat foraminous sieve aligned transversely between the frustoconical sieves. Alternately a pair of frustoconical foraminous sieves are aligned with each other and flare in a common direction. A sleeve having a pair of opposite ends each provided with a respective flat sieve can also form the foam generator.

The liquid pump can include a small-diameter liquid chamber opening directly into the foaming chamber, with no atomizing nozzle. Alternately the foam generator includes a nozzle connected between the liquid pump and the foaming chamber. The amount of air moved on operation of the system is 20 to 60 times greater than the amount of liquid moved, forming a light foam.

All parts of the housing, pumps, conduit, and foam generator that come into contact with the liquid or the foam are made of plastic. In addition a spring is braced between the housing and the pistons for urging same into respective end positions in each of which the respective chambers are at maximum volume. This spring can be wholly outside the structure so that, even though it is made of a corrosible steel, it is not exposed to the liquid.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
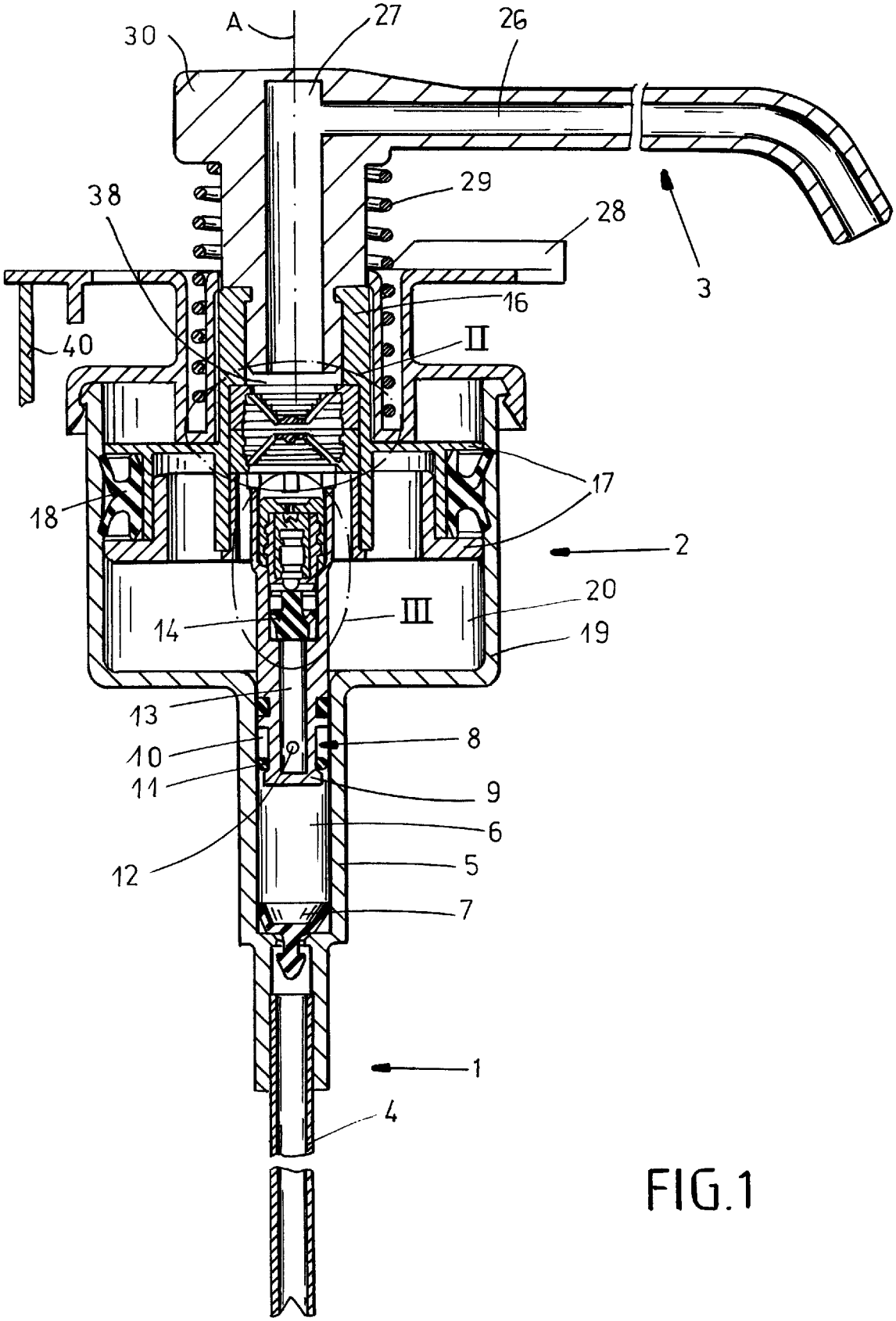
FIG. 1 is a vertical and axial section through a dispenser according to the invention.
Figure 2:
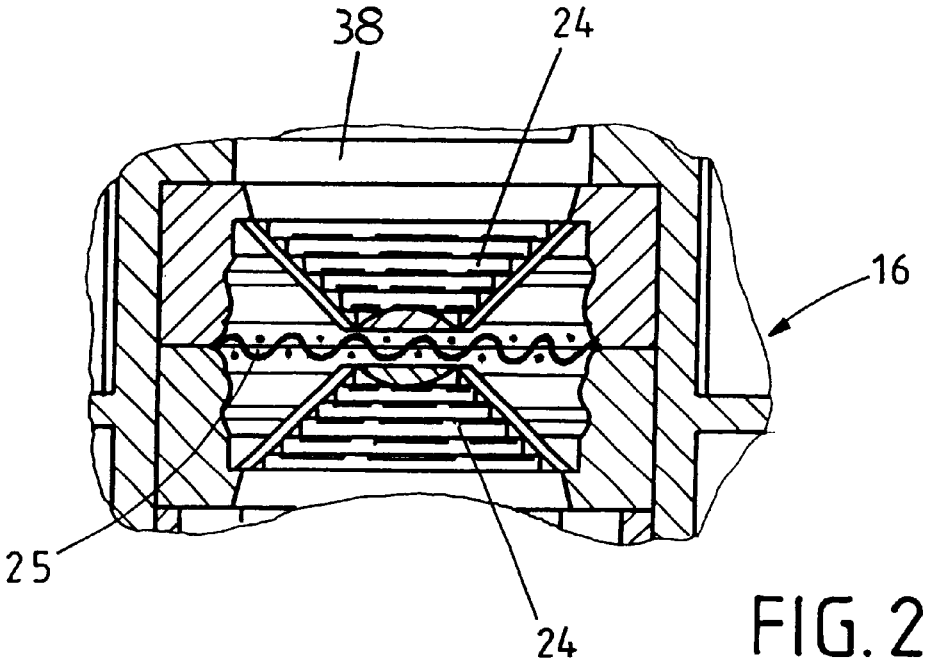
FIGS. 2 and 3 are large-scale views of the details indicated at II and III in FIG. 1.

As seen in FIGS. 1 through 4 a dispenser according to the invention basically has a lower intake part 1, a central pump assembly 2, and an upper outlet part 3, all generally centered on an upright axis A. The intake part 1 comprises an axially downwardly open intake tube 4 connected to a tubular lower extension 5 forming a cylindrical liquid chamber 6 centered on the axis A and projecting from a normally stationary housing 28. A lower end of the chamber 6 is provided where it is joined to the intake tube 4 with a one-piece rubber check valve 7 permitting flow only up into the chamber 6 from the tube 4.

A small-diameter lower liquid piston 9 is axially reciprocal in the chamber 6 and is formed as a tube 8 having an axially elongated and radially outwardly open circumferential groove 10 in which is fitted an O-ring 11 acting as a valve. The piston 9 is formed in the center of the groove 10 with a plurality of radially throughgoing ports 12 that open into a central passage 13 of the piston 9. The valve ring 11 is movable between a lower position below the ports 12 and preventing flow from the passage 13 into the chamber 6 and an upper position allowing free fluid flow from the chamber 6 into the passage 13.

Figure 3:
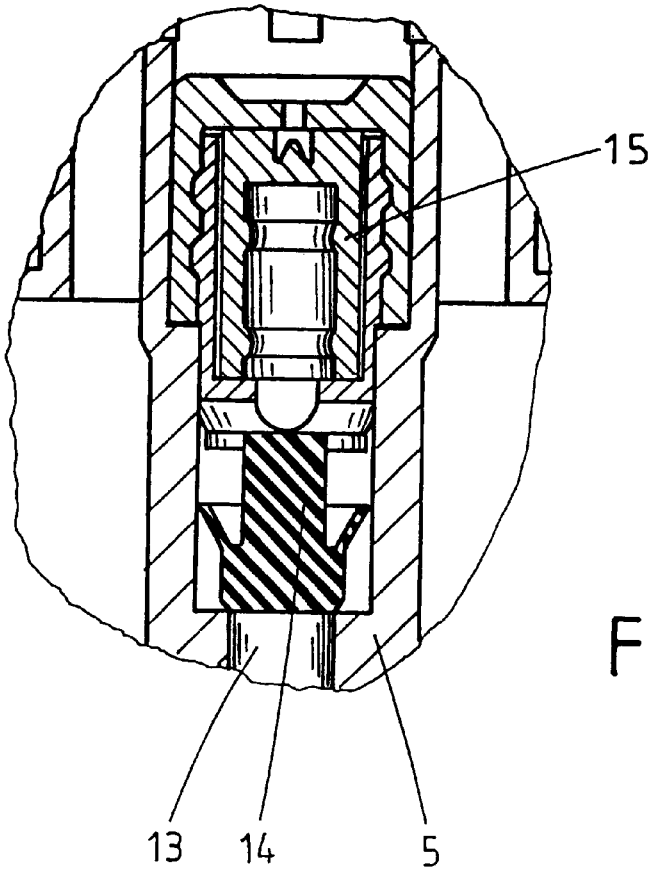

A one-piece elastomeric lip-type valve element 14 best seen in FIG. 3 is provided at the upper outlet end of the passage 13 and only allows flow from the passage 13 up into a foaming chamber 38 formed by a tubular part 16. Downstream of this check valve 14 is a foam-generating nozzle 15 of the type which, when pressurized with a liquid on one sides emits on the opposite side a swirling aerosol spray.

Figure 4:
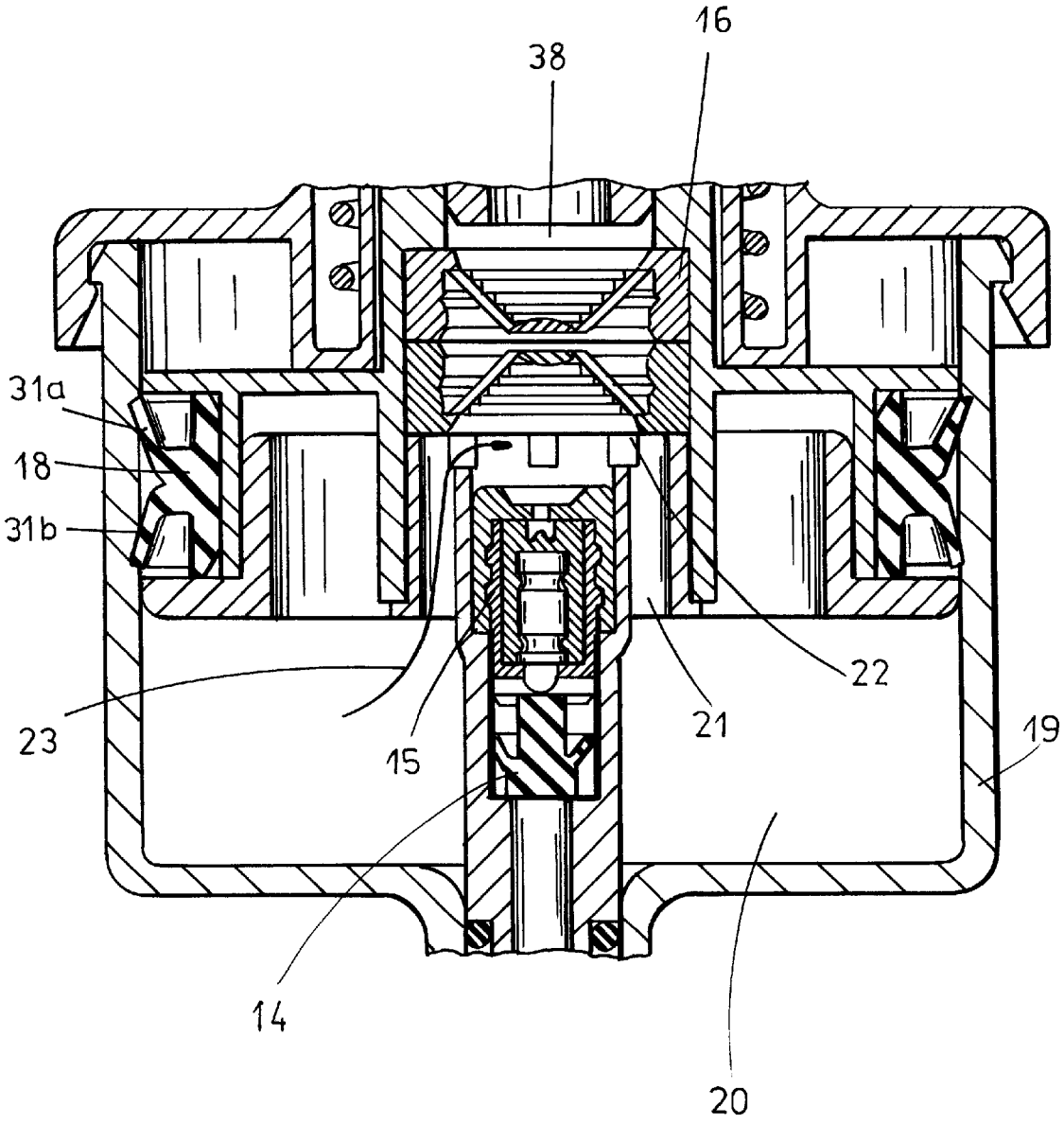
FIG. 4 is a view corresponding to the central region of FIG. 1 but showing other structural details.

A large-diameter air piston 17 having a seal 18 is unitary with the tube 8 forming the piston 9 and can reciprocate in a cylinder 19 forming an air chamber 20 that is fixed to the housing 28 and formed with the extension 5 so that both chambers 6 and 20 are coaxial, as are the pistons 9 and 17. FIG. 4 shows how axial passages 21 and radial ports 22 allow air flow from the chamber 20 into the chamber 38 as shown by arrow 23. The seal 18 is elastomeric and has a pair of axially opposite seal lips 31*a* and 31*b* so that flow into or out of the chamber 20 past the seal 18 is impossible.

The foaming chamber 38 holds a foam generator here constituted by two frustoconical foraminous sieves 24 having small-diameter closed ends that are turned toward each other and that flank a flat sieve screen 25. The part 16 forming the chamber 38 is fixed to the piston 17 and carries a nozzle 30 forming a horizontal passage 26 having an outer end open to the outside and an inner end connected via a vertical and axially centered passage 27 to the chamber 38. The passage 26 is always open and has a volume which is much less than the volume of the chamber 20 when the piston 17 is in the illustrated raised maximum-volume end position. The housing 28 is adapted to sit on the rim of a supply container 40 holding a body of liquid foamable soap or detergent.

This apparatus functions as follows:

Normally the spring 29 is extended to place the upper part 3 in the illustrated raised end position. The chambers 6 and 20 are at maximum volume and filled, respectively, with liquid soap and air. The valve 11 is in the lower position blocking flow down out of the passage 13 and the valves 7 and 14 are also closed. Everything is substantially at atmospheric pressure.

A user presses down on the part 3 or on an actuator lever or the like connected to it to simultaneously push down the pistons 6 and 7. Since the valve 7 prevents flow down out of the chamber 6, downward movement of the piston 9 will push up the valve ring 11 and the liquid in the chamber 6 will flow into the passage 13, past the check valve 14, and then up through the nozzle 15 to form a spray in the lower end of the chamber 38. Simultaneously downward movement of the piston 17 will force air up through the passages 21 and 22 into the lower end of the chamber 38. The combined liquid spray and air in the chamber 38 will pass through the foam-generating sieves 24 and 25 to form a foam that will flow through the passages 27 and 26 and out the end of the spout.

As soon as the part 3 stops and starts to return upward under the force of the spring 29, flow out of the compartments 6 and 20 will stop and the upwardly moving piston 17 will start to actually suck air and foam back down out of the chamber 38 and passages 26 and 27 into the chamber 20. Since the volume displaced by the piston 17 as it moves between its end positions is substantially greater than the volume of at least the horizontal passage 26, this will have the effect of sucking anything in the passage 26 back down into the apparatus so there will be no drip from the outer end of the passage 26.

At the same time that the piston 17 is returning upward, the piston 6 is synchronously moving upward. At the start of upward movement of the piston 6, the valve ring 11 shifts down to block flow out of the passage 13 and cause an under pressure in the chamber 6, thereby sucking a new charge of liquid up out of the supply container 40 past the check valve 7. Thus the system returns to its starting position shown in FIG. 1, with the chamber 6 filled with liquid and the chamber 20 filled with air and a small amount of foam.

Figures 5, 6:
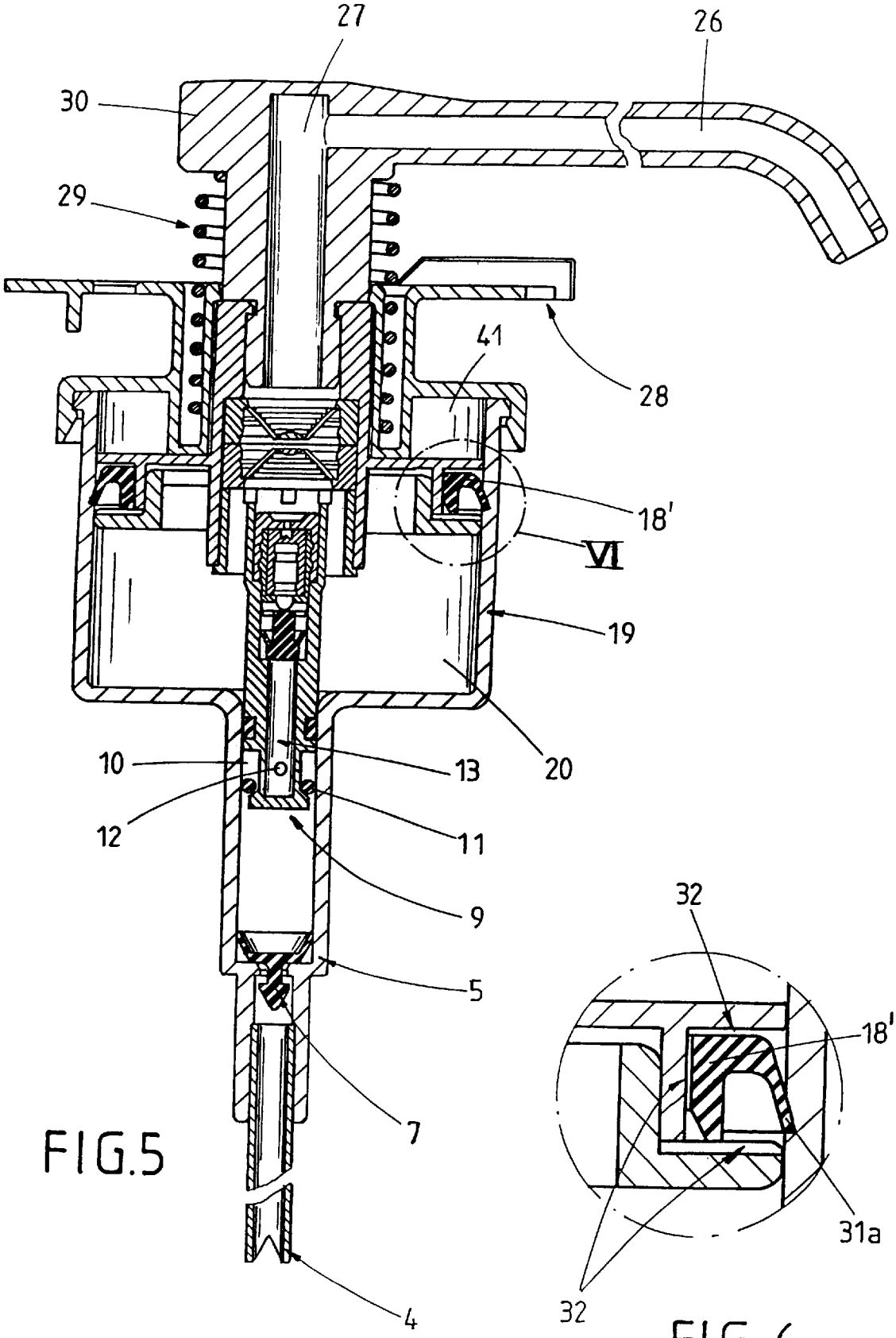
FIG. 5 is an axial section through another dispenser in accordance with the invention.
FIG. 6 is a large-scale view of the detail indicated at VI in FIG. 5.

In some situations, for instance hospital scrub rooms, sterility must be maintained at all times, so the ability of the system to suck back foam in the passage 26 is eliminated in order to prevent any bacteria or the like from being aspirated. Accordingly as shown in FIGS. 5 and 6 a single-lip seal 18' with a single lip 31*a* is used. This seal 18' therefore only seals the chamber 20 on downward travel of the piston 17, but allows on upward travel air to be sucked in spaces 32 around it for refilling of the chamber 20. The device is constructed to allow easy air flow into a space 41 above the piston 17 so that there will be no significant aspiration of the foam in the passage 26, 27.

Figure 7:
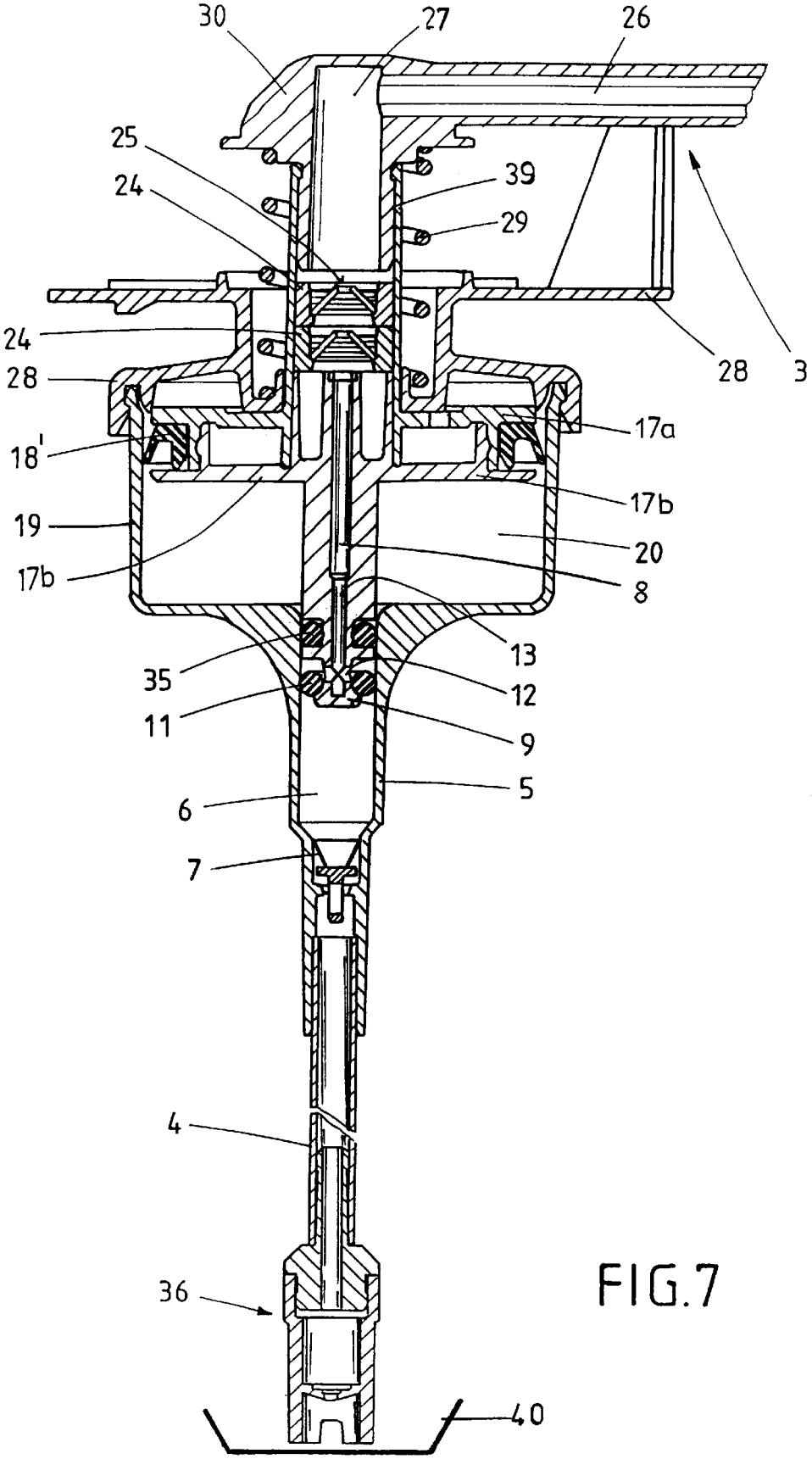
FIG. 7 is an axial section through yet another dispenser according to the invention in an unactuated or rest position.
Figure 8:
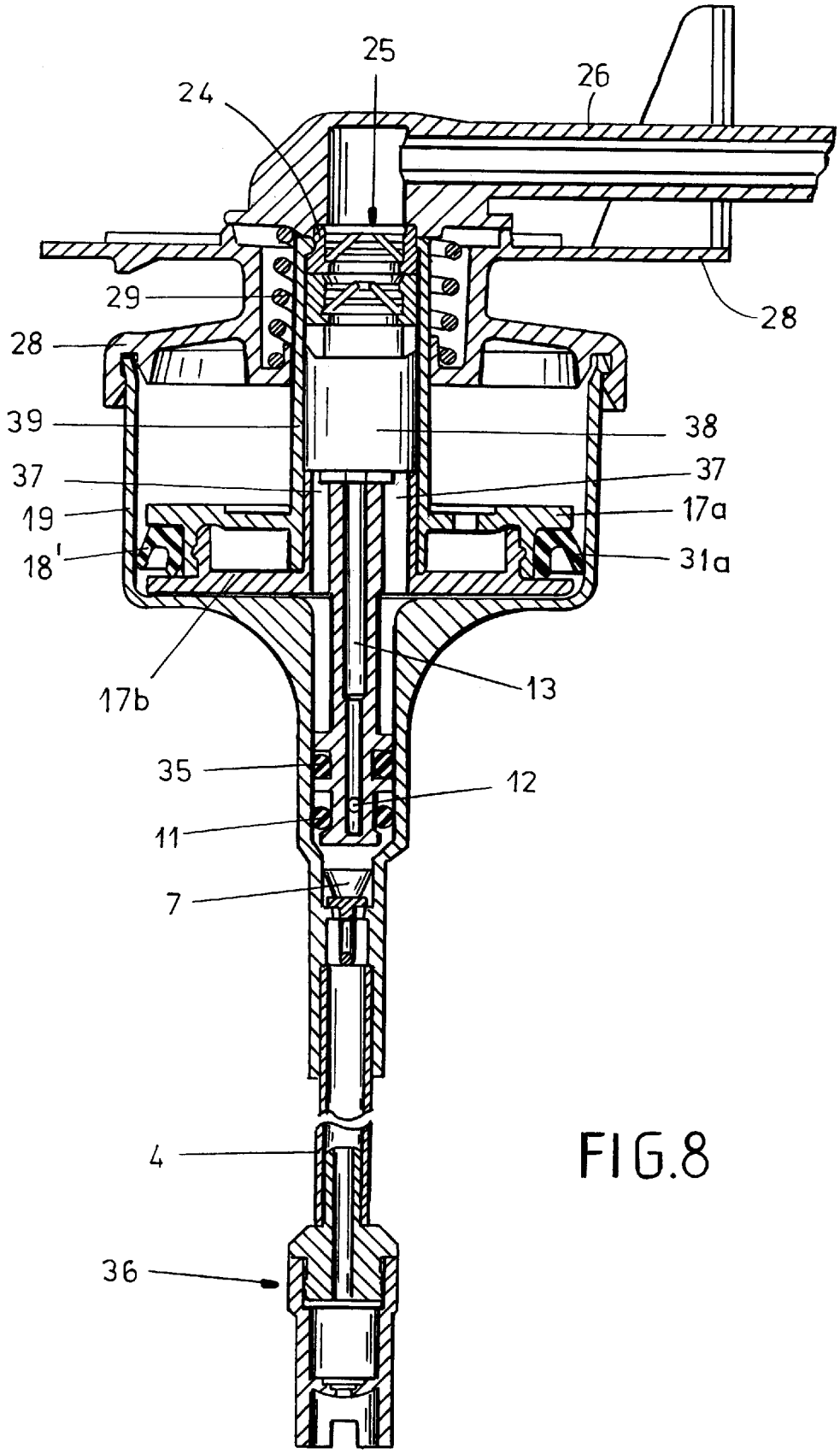
FIG. 8 is a view like FIG. 7 but showing the dispenser in the actuated position.

In the arrangement of FIGS. 7 and 8 the piston 9 is sealed by an O-ring 35 in the extension 5 forming the chamber 6. The two frustoconical foam-generating screens 24 are arranged flaring upstream and the flat screen 25 is provided downstream of the downstream screen 24. Furthermore there is no nozzle 15 but instead the passage 13 opens directly axially into the chamber 38 immediately upstream of the upstream foam-generating screen 24.

The piston 17 here is formed of two snapped-together parts 17*a* and 17*b* embracing the one-lip seal 18'. The upper piston part 17*a* is formed with an upwardly projecting sleeve 39 forming the chamber 38 and carrying the spout 30. Passages 37 extend from a lower face of the piston 17 to the chamber 38, opening around the upper outlet mouth of the passage 13. The lower end of the tube 4 carries a fitting 36 adapted to sit on the floor of the supply container 40 so that it can be essentially fully emptied.

This system works substantially like that of FIGS. 1 through 4. When the upper part 3 is pushed down relative to the housing 28, the piston 9 will force a stream of liquid soap up into the chamber 38 from the upper end of the passage 13 while the piston 17 will force air up around this stream so as to combine therewith on the foam-generating sieves 24 and 25 to form a foam that passes out through the passages 26 and 27. When the movable spout 30 and the pistons 9 and 17 are forced back up by the spring 29, air will be aspirated back into the passage 26 to clear it, while the valve 11 will close to ensure refilling of the chamber 6.

Figure 7A:
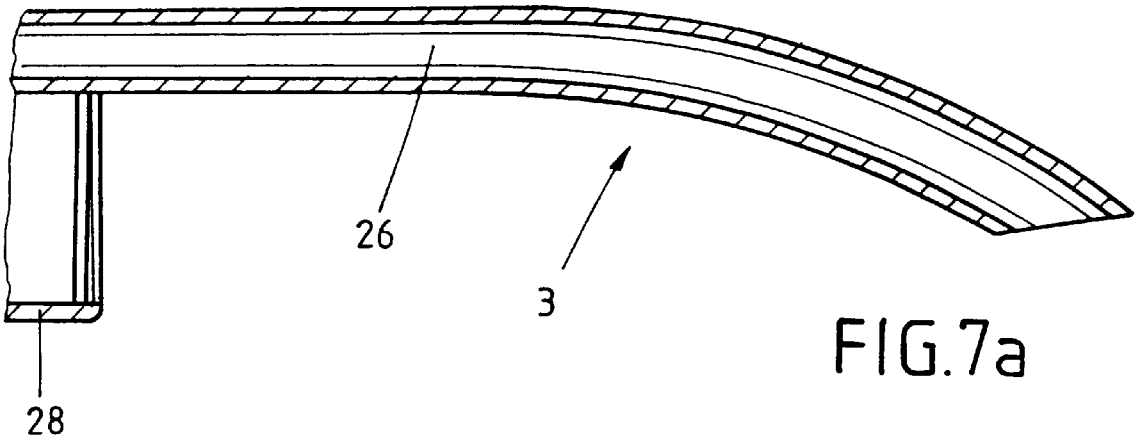
FIG. 7*a* is a sectional view of a detail of the dispenser of FIG. 7.
Figure 7B:
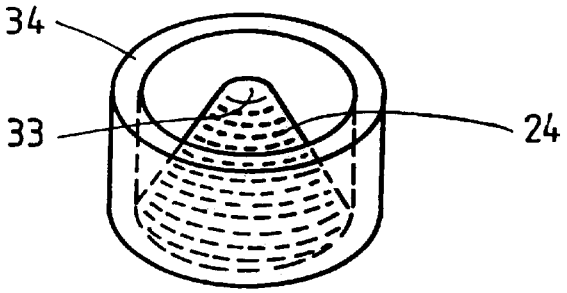
FIGS. 7*b* and 7*c* are perspective views of foam generators according to the invention.
Figure 7C:
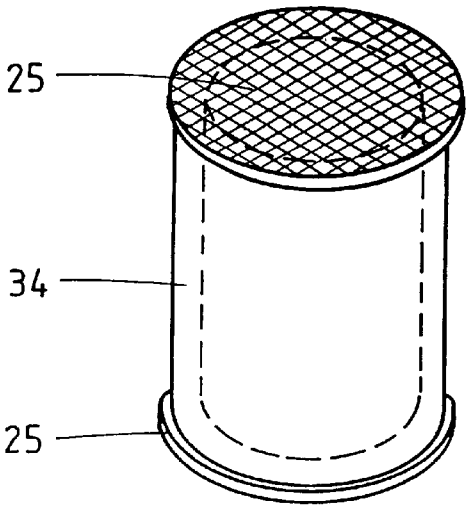

FIG. 7*a* shows how the outlet end of the spout 3 is below its inlet end. In FIG. 7*b* the frustoconical sieve screen 24 is shown to have a plugged small end 33 and to be carried in a mounting sleeve 34 of an axial dimension equal to the axial length of the sieve 24. FIG. 7*c* shows a cylindrical sleeve 34 with flat foam-generating screens 25 on both ends.

We claim:

1. An apparatus for making and dispensing foam, the apparatus comprising:

a housing forming a generally closed foaming chamber;

a conduit forming a continuously open passage having an inner end opening into the foaming chamber and an outer end open to outside, the conduit being closed except at its ends;

a liquid supply;

means connected to the supply and including a liquid pump having a small-diameter liquid chamber and a small-diameter liquid supply displaceable therein for drawing liquid from the supply and spraying the liquid into the foaming chamber;

means including an air pump having a large-diameter air chamber, an intake connected solely to the foaming chamber to draw air solely therefrom, and a large-diameter air piston displaceable therein between respective end positions and connected directly to the liquid piston for forcing air into the foaming chamber, the conduit, the air piston, and the air chamber being of such dimensions that displacement of the air piston between its end positions moves a volume of air greater than a volume of air held in the conduit between its ends; and means in the foaming chamber for mixing the spray and air therein to generate foam and expand the foam to flow through the conduit out the outer end thereof.

2. The foam dispenser defined in claim 1 wherein the supply is a vessel holding the liquid and to which the housing is removable attached.

3. The foam dispenser defined in claim 1 wherein the air pump includes an unlubricated seal between the air piston and an inner surface of the air chamber.

4. The foam dispenser defined in claim 3 wherein the seal is formed of polyethylene, polypropylene, or an elastomer.

5. The foam dispenser defined in claim 3 wherein the seal has a flexible lip engaging the surface at an acute angle.

6. The foam dispenser defined in claim 3 wherein the seal has a pair of oppositely directed flexible lips engaging the surface at acute angles.

7. The foam dispenser defined in claim 3 wherein the air piston moves in a predetermined forward direction to move air from the air chamber into the foaming chamber and the seal has a flexible lip projecting generally in the forward direction and engaging the surface at an acute angle.

8. The foam dispenser defined in claim 1 wherein the foam-generating means includes at least one sieve.

9. The foam dispenser defined in claim 1 wherein the foam-generating means includes a pair of frustoconical foraminous sieves aligned with and flaring away from each other.

10. The foam dispenser defined in claim 9 wherein the foam-generating means includes a flat foraminous sieve aligned transversely between the frustoconical sieves.

11. The foam dispenser defined in claim 1 wherein the foam-generating means includes a pair of frustoconical foraminous sieves aligned with each other and flaring in a common direction.

12. The foam dispenser defined in claim 1 wherein the foam-generation means includes a sleeve having a pair of opposite ends each provided with a respective flat sieve.

13. The foam dispenser defined in claim 1 wherein the foam-generating means includes a nozzle connected between the liquid pump and the foaming chamber.

14. The foam dispenser defined in claim 1 wherein the liquid pump moves on displacement of its piston between end positions a predetermined amount of liquid and the air pump moves on displacement of its position between its end positions a predetermined amount of air and coupled directly to the liquid piston, the predetermined amount of air being 20 to 60 times greater than the predetermined amount of liquid.

15. The foam dispenser defined in claim 1 wherein all parts of the housing, pumps, conduit, and foam-generating means that come into contact with the liquid or the foam are made of plastic.

16. The foam dispenser defined in claim 1, further comprising spring means braced between the housing and the pistons for urging same into respective end positions in each of which the respective chambers are at maximum volume.

17. An apparatus for making and dispensing foam, the apparatus comprising:

a housing forming a generally closed foaming chamber;

means including a liquid pump and a liquid supply for drawing liquid from the supply and spraying the liquid into the foaming chamber;

means including an air pump for forcing air into the foaming chamber;

a conduit forming a continuously open passage having an inner end opening into the foaming chamber and an outer end open to outside; and means in the foaming chamber including a pair of frustoconical foraminous sieves aligned with each other for mixing the spray and air therein to generate foam and expand the foam to flow through the conduit out the outer end thereof.

* * * * *